US006915095B2

(12) United States Patent
Longhenry et al.

(10) Patent No.: US 6,915,095 B2
(45) Date of Patent: Jul. 5, 2005

(54) CHARGING MEMBER HAVING TITANIUM OXIDE OUTER COATING ON GRIT BLASTED SUBSTRATE

(75) Inventors: Joy L. Longhenry, Webster, NY (US); Timothy R. Jaskowiak, Webster, NY (US); Kenneth W. Schlafer, Fairport, NY (US); Kevin H. Taft, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 44 days.

(21) Appl. No.: 10/462,539

(22) Filed: Jun. 16, 2003

(65) Prior Publication Data

US 2004/0253024 A1 Dec. 16, 2004

(51) Int. Cl.[7] ..... G03G 15/08
(52) U.S. Cl. ..... 399/266
(58) Field of Search ..... 399/266

(56) References Cited

U.S. PATENT DOCUMENTS

| | | | | |
|---|---|---|---|---|
| 2,836,725 A | | 5/1958 | Vyverberg | 250/49.5 |
| 4,034,061 A | | 7/1977 | McArthur | 423/213.5 |
| 4,086,650 A | | 4/1978 | Davis et al. | 361/229 |
| 5,473,418 A | | 12/1995 | Kazakos et al. | 355/259 |
| 6,226,483 B1 | * | 5/2001 | Kazakos et al. | 399/266 |
| 6,387,581 B1 | * | 5/2002 | Moffat et al. | |
| 6,468,402 B1 | * | 10/2002 | Vanderstraeten | |

* cited by examiner

*Primary Examiner*—Arthur T. Grimley
*Assistant Examiner*—Peter Lee
(74) *Attorney, Agent, or Firm*—Annette L. Bade

(57) ABSTRACT

A process for producing a charging member by grit blasting a charging member substrate, plasma spraying a single component outer coating consisting essentially of titanium dioxide powder directly to the grit blasted stainless steel substrate, and the outer coating has a resistivity of from about $10^{-10}$ to about $10^{-3}$ ohms-cm.

17 Claims, 2 Drawing Sheets

CHARGING MEMBER HAVING TITANIUM OXIDE OUTER COATING ON GRIT BLASTED SUBSTRATE

BACKGROUND OF THE INVENTION

The present invention relates to a process for producing a charging member, such as a donor member, or other like member, used in electrostatographic, including digital, apparatuses. The invention further relates to a process comprising grit blasting a charging member substrate or core, and plasma spraying a single component outer coating. The coating, in embodiments, consists essentially of titanium dioxide powder applied directly to said grit blasted stainless steel substrate or core. In further embodiments, the outer coating has a resistivity of from about $10^{-10}$ to about $10^{-3}$ ohms-cm. In embodiments, the titanium dioxide is "pure," and comprises from about 99 percent to about 100 percent by might titanium dioxide.

In the well-known process of electrophotographic printing, a charge retentive surface, typically known as a photoreceptor or photoconductor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface.

Thus, a toner image is produced in conformity with a light image of the original being reproduced. The toner image may then be transferred to a substrate or support member, such as paper, and the image affixed thereto to form a permanent record of the image to be reproduced. Subsequent to development, excess toner left on the charge retentive surface is cleaned from the surface.

The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor, is known as development. The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel.

Specifically, when the developer material is placed in a magnetic field, the carrier beads with the toner particles thereon form what is known as a magnetic brush, wherein the carrier beads form relatively long chains, which resemble the fibers of a brush. This magnetic brush is typically created by means of a developer roll. The developer roll is typically in the form of a cylindrical sleeve rotating around a fixed assembly of permanent magnets. The carrier beads form chains extending from the surface of the developer roll. The toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

Another known development technique involves a single-component developer, that is, a developer consisting entirely of toner. In a common type of single-component system, each toner particle has both an electrostatic charge to enable the particles to adhere to the photoreceptor, and magnetic properties to allow the particles to be magnetically conveyed to the photoreceptor. Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al.; U.S. Pat. No. 4,984,019 to Folkins; U.S. Pat. No. 5,010,367 to Hays; or U.S. Pat. No. 5,063,875 to Folkins et al. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image-on-image" color xerography.

A typical "hybrid" scavengeless development apparatus includes, within the developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, that is the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

In any type of scavengeless development apparatus, the donor member is used to convey toner particles to the wires forming the electrode structure in the nip between the donor roll and the photoreceptor. Broadly speaking, a donor member can be defined as any member having only toner particles adhering to the surface thereof.

To function commercially in scavengeless development, a donor member should meet certain requirements. In general, a donor member should include a conductive substrate and define a partially conductive surface, so that the toner particles may adhere electrostatically to the surface in a reasonably controllable fashion. In hybrid scavengeless development, the donor member provides an electrostatic intermediate between the photoreceptor and the transport member. The provision of this intermediate and the scavengeless nip minimizes unwanted interactions between the development system and the photoreceptor, in particular with a pre-developed latent image already on the photoreceptor, before the latent image in question is developed. Minimized interactions make scavengeless development preferable when a single photoreceptor is developed several times in a single process, as in color or highlight color xerography.

The donor member must further have desirable wear properties so the surface thereof will not be readily abraded by adjacent surfaces within the apparatus, such as the magnetic brush of a transport roll. Further, the surface of the donor member should be without anomalies such as pin holes, which holes may be created in the course of the manufacturing process for the donor roll. The reason that such small surface imperfections must be avoided is that any such imperfections, whether pinholes created in the manufacturing process or abrasions made in the course of use, can result in electrostatic "hot spots" caused by arcing in the vicinity of such structural imperfections.

Another desired property of the donor member is summarized by the phrase "uniform conductivity;" the surface of the donor roll must be partially conductive relative to a more conductive substrate, and this partial conductivity on the surface should be uniform through the entire circumferential surface area.

Other physical properties of the donor member, such as the mechanical adhesion of toner particles, are also desired, but are generally not as quantifiable in designing a development apparatus. In addition, the range of conductivity for the service of a donor member should be well chosen to maximize the efficiency of a donor member in view of any number of designed parameters, such as energy consumption, mechanical control and the discharge time-constant of the surface.

U.S. Pat. No. 6,226,483 B1 discloses an article including a cylindrical roller core, and a titanium dioxide ceramic layer bonded to the exterior of the cylindrical core, wherein the resistivity of the coated roller article can be from about $10^{-3}$ to about $10^{10}$ ohm-cm.

U.S. Pat. No. 5,869,808 discloses a thermal conductive roller for use in copying machines, steam-heated and induction-heated applications including a ceramic heating layer formed by plasma spraying a ceramic material to form an electrically conductive heating layer of preselected and controlled resistance.

U.S. Pat. No. 5,707,326 discloses a charging roller for use in xerographic copying machines including a cylindrical roller core, and a ceramic layer formed by plasma spraying of a blend of an insulating ceramic material and a semiconductive ceramic material in a ratio which is selected to control an RC circuit time constant of the ceramic layer in response to an applied voltage differential.

U.S. Pat. No. 5,701,572 discloses an apparatus including a cleaning brush or other cleaning device and a ceramic coated detoning roll resistive to wear.

U.S. Pat. No. 5,609,553 discloses an electrostatic assist roller for use in a coating, printing or copying machine, which includes a cylindrical roller core, and a ceramic layer formed by plasma spraying a blend of an insulating ceramic material and a semiconductive ceramic material in a ratio which is selected to control the resistance and thickness of the ceramic layer in response to an applied voltage differential.

U.S. Pat. No. 5,600,414 discloses a charging roller for use in a xerographic copying machine that includes a cylindrical roller core, and a ceramic layer formed by plasma spraying a blend of an insulating ceramic material and a semiconductive ceramic material in a ratio, which is selected to control an RC circuit time constant of the ceramic layer in response to an applied voltage differential.

U.S. Pat. No. 5,322,970 discloses a donor roll for the conveyance of toner in a development system for an electrophotographic printer including an outer surface of ceramic having a suitable conductivity to facilitate a discharge time constant thereof of less than 600 microseconds.

U.S. Pat. No. 5,043,768 discloses a rotating release liquid applying device for a fuser including an outer porous ceramic material.

U.S. Pat. No. 4,893,151 discloses a single component image developing apparatus including a developing roller coated with a Chemical Vapor Deposition ceramic and an elastic blade coated with a ceramic.

U.S. Pat. No. 4,544,828 discloses a heating device using ceramic particles as a heat source and adapted for use as a fixing apparatus.

The aforementioned patents are incorporated by reference herein in their entirety.

Recently, use of emulsion aggregation (EA) toner has become of interest. The EA toner is superior in many ways, including the fact that the toner can be processed easier and that the toner formed is spherical. The spherical shape of the toner allows for a more uniform and superior image. The EA toner also has superior print quality when printed on various substrates, such as rough substrates.

Most known developer members use a stainless steel coating that is plasma sprayed onto a stainless steel sleeve, and/or an aluminum or stainless steel sleeve that has been grit blasted by some method to roughen the surface. Although the stainless steel coating meets the wear resistance and electrical conductivity requirements of the coating, plasma spraying creates hazardous and possibly explosive products. The grit blasted surface has limitations on the degree of roughness (Rz) that can be achieved without distortion of the substrate itself.

Therefore, it is desired to provide a developer member coating that has the desired surface texture, wear resistance and electrical conductivity to work with EA toner. It is also desired to provide a developer member coating that is inert and remains inert during the plasma spray process. It is further desired to provide a developer member coating useful for semi-conductive magnetic brush development (SCMB). Moreover, it is desired to provide a coating for a development member that does not require blending of two materials. Further, it is desired that the coating not require an over-firing step to meet the desired electrical properties. Another desired property of the coating, is that the process for producing the coating not be hazardous or explosive.

SUMMARY OF THE INVENTION

Embodiments of the present invention, include a process for producing a charging member comprising a) grit blasting a charging member substrate; b) plasma spraying a single component outer coating consisting essentially of titanium dioxide powder directly to the grit blasted stainless steel substrate, wherein the outer coating has a resistivity of from about $10^{-10}$ to about $10^{-3}$ ohms-cm.

Embodiments further include a process for producing a charging member for use in combination with emulsion aggregation toner in an electrostatographic apparatus, comprising a) grit blasting a stainless steel charging member substrate; b) plasma spraying a single component outer coating consisting essentially of titanium dioxide powder directly to the grit blasted stainless steel substrate, wherein the outer coating has a resistivity of from about $10^{-10}$ to about $10^{-3}$ ohms-cm.

In addition, embodiments include an electrostatographic apparatus comprising a) a housing defining a chamber for storing a supply of toner particles therein; b) a donor member comprising an electrically conductive substrate, and an outer layer, the donor member comprising i) a grit blasted charging member substrate having directly applied thereto, and ii) a plasma sprayed single component outer coating consisting essentially of titanium dioxide powder, wherein the outer coating has a resistivity of from about $10^{-10}$ to about $10^{-3}$ ohms-cm; the donor member being mounted at least partially in the chamber of the housing and being adapted to advance toner particles from the chamber to a latent image residing on an image bearing member; and c) an electrode member positioned between the latent image bearing member and the outer surface of the donor member, the electrode member being closely spaced from the outer coating of the donor member and being electrically biased to detach toner particles from the outer coating of the donor member so as to form a toner powder cloud in the space between the electrode member and the latent image with detached toner particles from the toner powder cloud thereby developing the latent image.

DETAILED DESCRIPTION OF THE INVENTION

The present invention relates to a process for producing a charging member, such as a donor member, or other like member, used in electrostatographic, including digital, apparatus. The invention further relates to a process comprising grit blasting a charging member substrate, and plasma spraying a single component outer coating thereon. The invention further relates to an electrostatographic apparatus comprising the donor member. The outer coating, in embodiments, consists essentially of titanium dioxide powder applied directly to the grit blasted stainless steel substrate. In further embodiments, the outer coating has a resistivity of from about $10^{-10}$ to about $10^{-3}$ ohms-cm. In embodiments, the titanium dioxide is "pure," and comprises from about 99 percent to about 100 percent by weight titanium dioxide.

Figure 1:
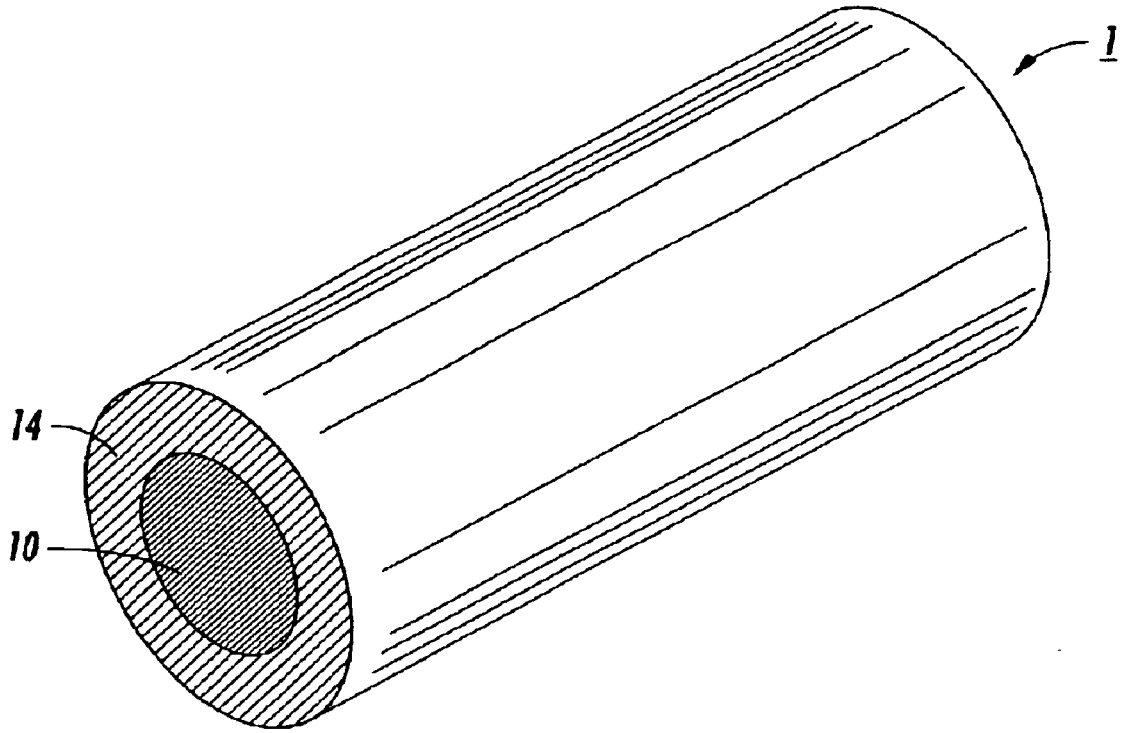
FIG. 1 shows a perspective view of an exemplary roll of an embodiment of the present invention.

FIG. 1 shows a roll 1 with a roller substrate 10, such as an electrically conductive material, an outer layer 14 bonded to the substrate and comprising titania.

Figure 2:
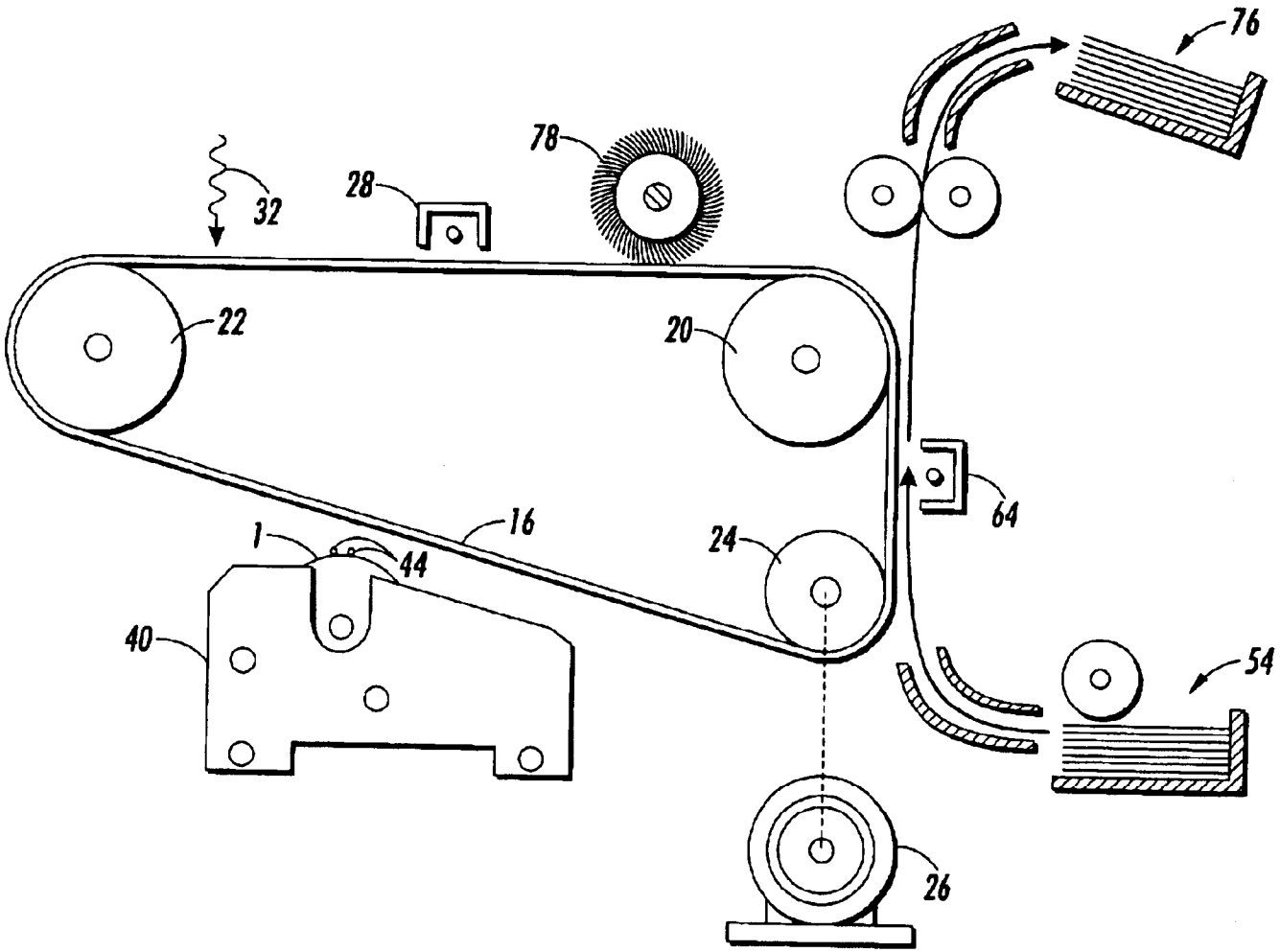
FIG. 2 is a schematic drawing of an exemplary printing machine employing an embodiment of a donor roll in accordance with an embodiment of the present invention.

FIG. 2 shows partial aspects of an exemplary electrostatographic machine employing a donor roll 1. An embodiment of an electrostatic apparatus, which is a printing machine, is disclosed. The printing machine comprises a photoreceptor 16, supported by rollers 20, 22 and 24, and driven by motor 26 and charger 28, an image exposure source 32, a developer housing 40 containing donor roller 1, and electrode wires 44. The printed Image receiver member, such as sheets 54, receive a developed latent Image by transfer of the Image from the photoreceptor member 16 charged by charger 64 to the sheets 54. The sheets then advance to a fusing station, wherein the latent developed image is fused to a copy substrate to form produce printed image receiver sheets 76. Cleaning 78 cleans the residual toner from photoreceptor belt 16.

In embodiments, the development or donor member is used for semi-conductive magnetic brush (SCMB) development. However, the methods and techniques described herein can be employed to produce development members for other development systems also. Examples of other development systems include hybrid scavengeless development, hybrid jumping development, and standard magnetic development.

In embodiments, the development or donor member is useful with emulsion aggregation (EA) toner. This toner is characterized by being spherical in shape. The EA toner is superior in many ways, including the fact that the toner can be processed easier and that the toner formed is spherical. EA toner is processed using a new emulsion aggregation method, rather than resin synthesis followed by extrusion, which is the way most known toners are processed. This new emulsion aggregation method allows for controlled-growth of the particles. An advantage is image precision (sharper lines and clarity in the print). The spherical shape of the toner allows for a more uniform and superior image. The EA also has superior print quality when printed on various substrates, such as rough substrates. One unique characteristic of EA toner is the toner concentration mass (TCM), which requires a developer member that has a specific surface texture to properly develop the toner.

Emulsion/aggregation/coalescence processes for the preparation of toners are illustrated in a number of Xerox Corporation patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,858,601, and 5,977,210.

The donor member may be in the form of a roller, belt, film, sheet, sleeve, drelt (hybrid of a drum and a belt), or other configuration.

The development member can be made by first grit blasting a substrate. The substrate may comprise a material selected from metals, metal alloys, composites, ceramics, and mixtures thereof. In embodiments, the substrate is a metal substrate such as stainless steel, aluminum, carbon steel, ferrous and non-ferrous materials, and the like. In embodiments, the donor roller substrate comprises grit-blasted stainless steel.

Titania is then plasma sprayed directly on or over the grit blasted substrate. Plasma spray coating technology is known and described in, for example, "Plasma-spray Coating", *Scientific American*, September 1988, pp. 112–117. In embodiments, pure titania, or titania having from about 99 percent to about 100 percent by weight titanium dioxide, is used. Titania is an inert ceramic that, prior to being subjected to the plasma spray process, is electrically insulative. The coating is created by spraying titania powder using plasma spray, which is a thermal spray process that melts the powder particles and propels this molten material to a substrate. The molten titania quenches onto the substrate, thus forming a titania coating. Plasma sprayed titania is rendered electrically conductive by undergoing reduction during the plasma spray process. The resulting coated article is electrostatically chargeable, that is, the development member is conductive and the coating layer is semi-conductive or semi-insulating and is capable of holding a charge for a period of time without dissipation or leakage.

Surface texture is a feature of the development member. For a new toner formulation such as EA toner, the surface needs to be rough enough to pick up and move toner, but not to trap it onto the substrate. If the coating is too smooth, on the other hand, the toner is not picked up at all by the donor or development member. In embodiments, the surface roughness (Rz, which is a measure of surface depth) of the outer coating is from about 25 to about 75, or from about 35 to about 55 microinches.

To obtain the proper surface texture, the particle size distribution of the starting titania powder is carefully selected. In embodiments, the particle size of the titania is from about 10 to about 100 microns, or from about 10 to about 75 microns.

Using relatively pure titania (comprising from about 99 to about 100 percent by weight titanium dioxide) having specific particle sizes, offers several advantages over alternative materials as it is a single powder, and therefore, it eliminates the need to blend two powders together. Further, an oven-firing step is eliminated. The oven-firing step was previously needed in order to provide the desired electrical conductivity. Further, because the titania is inert, and the products formed during plasma spraying are inert, it is an environmentally friendly material to spray. This is unlike stainless steel. Stainless steel may be hazardous to spray due to its chromium content and the powder used in the process may be explosive.

In embodiments, the resistivity of the outer coating of the coated donor member can be, for example, from about $10^{-10}$ to about $10^{-3}$ ohms-cm, or from about $10^{-9}$ to about $10^{-4}$ ohms-cm, or from about $10^{-7}$ to about $10^{-4}$ ohms-cm.

The thickness of the titanium dioxide outer layer can be from about 25 to about 450 micrometers, or from about 50 to about 100 micrometers.

The development member may be housed in a development chamber. The chamber may also include an electrode member that can include a plurality of wires spaced from one another, a transport member mounted in the chamber of the housing and being positioned adjacent the ceramic outer surface of the donor or development member, the transport member being adapted to advance toner particles to the ceramic outer surface of the donor roll.

The printing machine, which is an embodiment of the present invention, can further comprise applying an alternating electric field between the donor or development member and the transport member to assist in the transfer of at least a portion of toner particles from the transport member to the outer surface of the donor or development member, wherein the applied electrical field alternates at a selected frequency, for example, from between about 200 Hz and about 20 kHz with a voltage of from about 200 to about 400 Vrms.

Single component development systems use a donor member for transporting charged toner to the development nip defined by the donor member and photoconductive member. The toner is developed on the latent image recorded on the photoconductive member by a combination of mechanical and/or electrical forces.

Scavengeless development and jumping development are two types of single component development systems that can be selected. In embodiments the electrode member can include a hybrid jumping development configuration, reference for example, U.S. Pat. No. 5,587,224. In jumping development, an AC voltage is applied to the donor member for detaching toner from the donor member and projecting the toner toward the photoconductive member so that the electrostatic fields associated with the latent image attract the toner to develop the latent image.

Single component development systems appear to offer advantages in low cost and design simplicity. However, the achievement of high reliability and simple, economic manufacturability of the system continue to present problems. Two component development systems have been used extensively in many different types of printing machines. A two component development system usually employs a magnetic brush developer member for transporting carrier having toner adhering triboelectrically thereto. The electrostatic fields associated with the latent image attract the toner from the carrier so as to develop the latent image. In high-speed commercial printing machines, a two component development system may have lower operating costs than a single component development system.

Clearly, two component development systems and single component development systems each have their own advantages. Accordingly, it is considered desirable to combine these systems to form a hybrid development system having the desirable features of each system. For example, at the Second International Congress on Advances in Non-Impact Printing held in Washington, D.C. on Nov. 4 to 8, 1984, sponsored by the Society for Photographic Scientists and Engineers, there was described a development system using a donor roll and a magnetic roller. The donor roll and magnetic roller were electrically biased. The magnetic roller transported a two component developer material to the nip defined by the donor roll and magnetic roller, and toner is attracted to the donor roll from the magnetic roll. The donor roll is rotated synchronously with the photoconductive drum with the gap there between being about 0.20 millimeter. The large difference in potential between the donor roll and latent image recorded on the photoconductive drum causes the toner to jump across the gap from the donor roll to the latent image and thereby develop the latent image.

As an example of an embodiment of the present invention, there is provided an apparatus for developing electrostatic latent images. A housing defines a chamber for storing a supply of toner particles therein. A donor member, with an outer surface, is mounted at least partially in the chamber of the housing to advance toner particles to the latent image. An electrode member is positioned in the space between the latent image and the donor member, closely spaced from the ceramic surface of the donor member and electrically biased to detach toner particles therefrom so as to form a toner powder cloud in the space between the electrode member and the latent image with detached toner particles from the toner cloud developing the latent image.

The invention will further be illustrated in the following non-limiting examples, it being understood that these examples are intended to be illustrative only and that the invention is not intended to be limited to the materials, conditions, process parameters, and the like, recited herein. Parts and percentages are by weight of total solids, unless otherwise indicated.

EXAMPLE I

Preparation of Titanium Dioxide Plasma Coated Roller Substrate

A suitable roller substrate or core was selected and constructed of seamless 302 stainless steel. This steel was chosen for its machine-ability, mechanical properties, and non-magnetic properties. The roller's physical dimensions do not appear to be critical to formation of a satisfactory titanium dioxide ceramic layer, because a variety of roller dimensions produced satisfactory coating in accordance with the present invention. Suitable alternative substrates include any other steels or materials that function similarly or better than the exemplary 302 stainless. Other suitable materials are metals, composites, ceramics, and the like materials that can withstand elevated temperatures and minimize thermal expansion.

The sleeve was turned on a lathe, by staging it on the inside diameter. The outside diameter was machined. The surface of the sleeve was then grit-blasted with 80 aluminum oxide grit to a suitable surface finish.

EXAMPLE II

Preparation of Bond Coat

Although a bond coat is not required, it is possible to use one to enhance adhesion of the coating to the roller or sleeve. A chrome aluminum yttrium cobalt powder, commercially available from Praxair as CO-106-1, can be plasma sprayed over a grit-blasted steel substrate according to manufacturer recommended spray parameters accompanying the powder. This would be followed by an optional plasma spray mid-coat consisting of a 1:1 by volume mixture of chrome aluminum yttrium cobalt powder and titanium dioxide commercially available from Sulzer Metco as 102. Other commercially available bond coats are believed to be useful for either or both bond or mid-coating.

EXAMPLE III

Titanium Oxide Ceramic Coating

A plasma spray coating of the $TiO_2$ ceramic layer was accomplished with Praxair Thermal Spray Equipment using a SG 100 torch. Plasma gases included: primary gas of argon (at 91 standard cubic feet per hour or "SCFH"), and secondary gas of helium (at 35 SCFH). Carrier flow was also argon gas at 9 SCFH. The metal oxide was titanium dioxide from FJ Brodman Co. having a powder size range of from about 10 to about 75 microns. A gun current level of 900 amps was sufficient to melt the powder. Alternative plasma coating approaches can use other equipment, gases, and/or powder particle sizes, wherein parameters are adjusted accordingly to achieve the same or similar result. For example, High Velocity Oxy Fuel (HVOF) or other thermal spray processes are believed to be adaptable and satisfactory to achieving comparable and equivalent coating results.

Other modifications of the present invention may occur to one of ordinary skill in the art based upon a review of the present application and these modifications, including equivalents thereof, are intended to be included within the scope of the present invention.

What is claimed is:

1. A process for producing a charging member for use in combination with emulsion aggregation toner in an electrostatographic apparatus, comprising:

a) grit blasting a stainless steel charging member substrate;

b) plasma spraying a single component outer coating consisting essentially of titanium dioxide powder directly to the grit blasted stainless steel substrate, wherein the outer coating has a resistivity of from about $10^{-9}$ to about $10^{-4}$ ohms-cm.

2. A process for producing a charging member as claimed in claim 1, wherein the resistivity is from about $10^{-7}$ to about $10^{-4}$ ohms-cm.

3. A process for producing a charging member as claimed in claim 1, wherein the titanium dioxide comprises from about 99 percent to about 100 percent by weight titanium dioxide.

4. A process for producing a charging member as claimed in claim 1, wherein the titanium dioxide has a particle size of from about 10 to about 100 microns.

5. A process for producing a charging member as claimed in claim 4, wherein the titanium dioxide has a particle size of from about 10 to about 75 microns.

6. A process for producing a charging member as claimed in claim 1, wherein the outer coating has a surface roughness (Rz) of from about 25 to about 75 microinches.

7. A process for producing a charging member as claimed in claim 6, wherein said surface roughness (Rz) is from about 35 to about 55 microinches.

8. A process for producing a charging member as claimed in claim 1, wherein the substrate comprises a material selected from the group consisting of metals, metal alloys, composites, ceramics, and mixtures thereof.

9. A process for producing a charging member as claimed in claim 8, wherein the substrate comprises a metal selected from the group consisting of stainless steel, aluminum, carbon steel, and ferrous materials.

10. A process for producing a charging member as claimed in claim 1, wherein the charging member is a donor roll useful in donating toner for development of a latent image with said toner in an electrostatographic apparatus.

11. A process for producing a charging member as claimed in claim 1, wherein the outer coating has a thickness of from about 25 to about 450 micorometers.

12. A process for producing a charging member as claimed in claim 11, wherein the outer coating has a thickness of from about 50 to about 100 micrometers.

13. A process for producing a charging member as claimed in claim 1, wherein said substrate is in the form of a cylindrical core.

14. An electrostatographic apparatus comprising:

a) a housing defining a chamber for storing a supply of toner particles therein;

b) a donor member comprising an electrically conductive substrate, and an outer layer, the donor member comprising i) a grit blasted charging member substrate having directly applied thereto, and ii) a plasma sprayed single component outer coating consisting essentially of titanium dioxide powder, wherein the outer coating has a resistivity of from about $10^{-9}$ to about $10^{-4}$ ohms-cm; the donor member being mounted at least partially in the chamber of the housing and being adapted to advance toner particles from the chamber to a latent image residing on an image bearing member; and c) an electrode member positioned between the latent image bearing member and the outer surface of the donor member, the electrode member being closely spaced from the outer coating of the donor member and being electrically biased to detach toner particles from the outer coating of the donor member so as to form a toner powder cloud in the space between the electrode member and the latent image with detached toner particles from the toner powder cloud thereby developing the latent image, wherein said toner particles comprise emulsion aggregation toner particles.

15. An electrostatographic apparatus in accordance with claim 14, wherein the resistivity is from about $10^{-7}$ to about $10^{-4}$ ohms-cm.

16. An electrostatographic apparatus in accordance with claim 14, wherein the titanium dioxide comprises from about 99 percent to about 100 percent by weight titanium dioxide.

17. An electrostatographic apparatus in accordance with claim 14, wherein the titanium dioxide has a particle size of from about 10 to about 100 microns.

* * * * *